US007116926B2

(12) United States Patent
Tsusaka

(10) Patent No.: US 7,116,926 B2
(45) Date of Patent: Oct. 3, 2006

(54) IMAGE FORMING DEVICE CAPABLE OF EASILY RESOLVING PAPER JAM

(75) Inventor: Shusaku Tsusaka, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 161 days.

(21) Appl. No.: 10/868,930

(22) Filed: Jun. 17, 2004

(65) Prior Publication Data

US 2004/0265002 A1 Dec. 30, 2004

(30) Foreign Application Priority Data

Jun. 27, 2003 (JP) ..... 2003-185301

(51) Int. Cl.
*G03G 21/00* (2006.01)

(52) U.S. Cl. ..... 399/124

(58) Field of Classification Search ..... 399/124, 399/98, 110–114; 74/352
See application file for complete search history.

(56) References Cited

U.S. PATENT DOCUMENTS 5,813,344 A * 9/1998 Maruyama et al. ..... 399/99 X
6,075,958 A * 6/2000 Gotoh et al. ..... 399/124
2003/0049043 A1* 3/2003 Fuwazaki et al. ..... 399/98

FOREIGN PATENT DOCUMENTS

| | | |
|---|---|---|
| JP | A 5-32348 | 2/1993 |
| JP | A 10-25037 | 1/1998 |
| JP | A 10-39563 | 2/1998 |
| JP | A 2001-72278 | 3/2001 |
| JP | A 2002-104694 | 4/2002 |

* cited by examiner

*Primary Examiner*—David M. Gray
*Assistant Examiner*—Erika J. Villaluna
(74) *Attorney, Agent, or Firm*—Oliff & Berridge, PLC

(57) ABSTRACT

A dial is provided to a laser printer such that only a portion of the dial is exposed in an accommodating area for accommodating a process cartridge. A user can manually rotate a conveying roller to convey a paper through a conveying path by operating the dial. The dial is disposed coaxial with an auger. The auger operates in association with the conveying roller because of an auger gear being engaged with a conveying gear. A driving force from a driving motor is transmitted to the conveying gear via a planetary gear. When a paper jam occurs, the user operates the dial in order to move the planetary gear, thereby switching the state for communicating the driving force from the drive motor to the conveying roller from a communicating state to a non-communicating state.

17 Claims, 4 Drawing Sheets

IMAGE FORMING DEVICE CAPABLE OF EASILY RESOLVING PAPER JAM

BACKGROUND OF THE INVENTION

1. Field of the Invention

The present invention relates to an image-forming device that easily eliminates obstructions along a conveying path of a recording medium.

2. Related Art

Image-forming devices such as printers, facsimile machines, copy machines, or multifunction devices combining the functions of these machines are well known in the art. In one type of image-forming device, an image-forming unit charges a photosensitive member and subsequently exposes the photosensitive member to light from a laser, LED, or the like to form electrostatic latent images thereon. The electrostatic latent image is developed using toner or other type of developer. The developed image is then transferred onto a recording medium and is fixed on the recording medium by heat generated in a fixing unit, thereby forming an image on the recording medium. In this type of image-forming device, a conveying path is formed from a point that a recording medium is fed into a casing to a point that the recording medium is discharged from the casing after passing through an image-forming unit, enabling the recording medium to be conveyed through the casing without becoming jammed.

When paper becomes jammed on the conveying path, a process is performed to remove the jammed paper from the path. In a large image-forming device, maintenance hatches may be provided at a plurality of locations on the outer walls of the casing, since there are many options for arranging the components in the casing of the large image-forming device. Accordingly, a user can reach and easily remove jammed paper by opening the appropriate hatch. However, it is more difficult to provide a plurality of maintenance hatches on a small image-forming device, such as that described in Japanese unexamined patent application publication No. 2002-104694. For this reason, a portion of the conveying path is configured of an accommodating area that accommodates a removable process unit (process cartridge), which functions to form images. With this construction, the user can access the conveying path to resolve a paper jam by first removing the process unit from the casing.

Components of the image-forming device described in Japanese unexamined patent application publication No. 2002-104694 are arranged three-dimensionally in the casing of the image-forming device to achieve a compact design. A paper tray (paper supply cassette) is disposed in the bottom section of the casing. Paper picked up from the paper tray by a feeding roller is conveyed by conveying rollers working in association with the feeding roller along a U-shaped conveying path for guiding the paper onto a path within the process unit. If a paper jam occurs on the U-shaped conveying path, the user resolves the paper jam by removing the process unit from the accommodating area and pulling the jammed paper from the end of the U-shaped conveying path exposed in the accommodating area.

SUMMARY OF THE INVENTION

However, when paper becomes jammed in a laser printer such as that described in Japanese unexamined patent application publication No. 2002-104694, the leading edge of the paper may not be exposed in the accommodating area, depending on the position of the jammed paper in the conveying path. Moreover, the paper may ripple into accordion-like folds and become densely packed in the conveying path. As a result, it can be difficult to remove the jammed paper from the conveying path.

In view of the foregoing, it is an object of the present invention to overcome the above problems and also to provide an image-forming device that enables a user to manually rotate conveying rollers in order to resolve a paper jam.

In order to attain the above and other objects, according to one aspect of the present invention, there is provided an image-forming device including a casing within which an accommodating area is formed, a process cartridge that is detachably accommodated in the accommodating area, a conveying roller that conveys a recording medium along a conveying path, and a driving member. The process cartridge is accommodated along a section of the conveying path. The driving member is disposed at a position other than a position at which the driving member interferes with the process cartridge when the process cartridge is mounted or removed from the accommodating area and with the recording medium being conveyed. The driving member enables manual driving of the conveying roller.

PREFERRED EMBODIMENT OF THE PRESENT INVENTION

Figure 1:
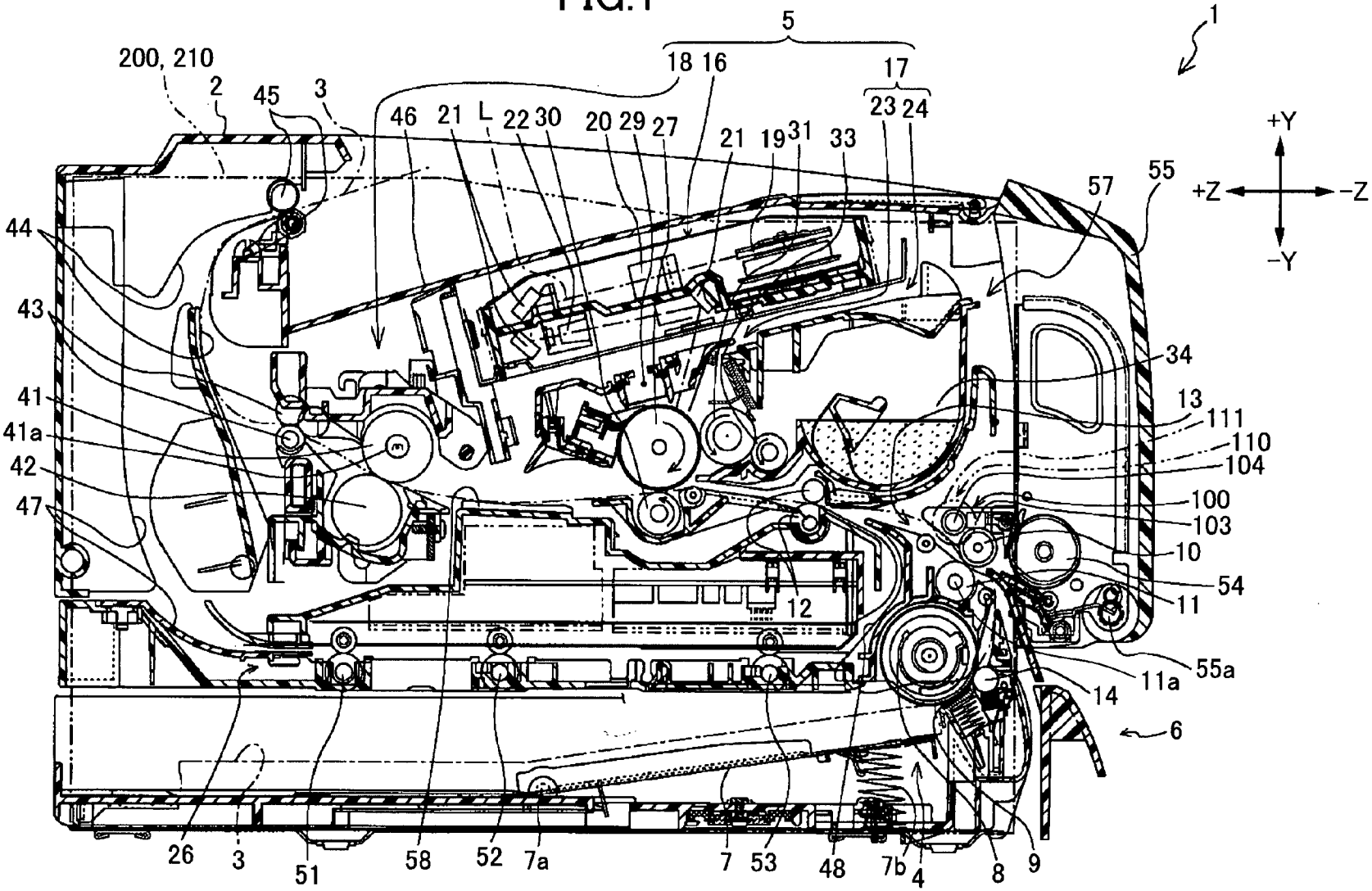
FIG. 1 is a is a center cross-sectional view of a laser printer according to an embodiment of the present invention.

An image-forming device according to a preferred embodiment of the present invention will be described while referring to the accompanying drawings. First, the overall construction of a laser printer 1, serving as an example of the image-forming device, will be described with reference to FIG. 1. FIG. 1 is a center cross-sectional view of the laser printer 1. It should be noted that, in the drawings, directions −Z, +Z, −X, +X, +Y, and −Y indicate frontward, rearward, leftward, rightward, upward, and downward directions, respectively, of the laser printer 1.

As shown in FIG. 1, the laser printer 1 includes a casing 2 and, within the casing 2, a feeder unit 4 for supplying paper and an image-forming unit 5 for forming images on paper supplied from the feeder unit 4. The image-forming unit 5 includes a scanning unit 16, a process cartridge 17, and a fixing unit 18. The aforementioned components are fixed or supported at positions between two frames 200 and 210 provided on the left and right sides of the casing 2 (in the foreground and background of FIG. 1).

The feeder unit 4 includes a sheet feed cassette 6, a sheet feed roller 8, a conveying roller 11, and a pair of registration rollers 12. The sheet feed cassette 6 is detachably mounted in the bottom section of the casing 2 and is inserted or removed from the front surface side of the laser printer 1 in the front-to-back direction. A paper pressing plate 7 is disposed in the sheet feed cassette 6 for supporting a stack of paper 3. A support shaft 7*a* is disposed on an end of the paper pressing plate 7 furthest away from the front side of the sheet feed cassette 6 for pivotably supporting the paper pressing plate 7 on the bottom surface of the sheet feed cassette 6 and enabling an opposite end of the paper pressing plate 7 near the front surface of the sheet feed cassette 6 to move vertically. A spring 7*b* is disposed beneath the free end of the paper pressing plate 7 and urges the free end upward.

The sheet feed roller 8 is positioned above the free end of the paper pressing plate 7 so that the paper 3 stacked on the paper pressing plate 7 is pressed into the sheet feed roller 8. The sheet feed roller 8 has an axial length of approximately one-fourth the width of the paper 3 (the maximum width of paper that can be stacked on the paper pressing plate 7) and is disposed in the approximate widthwise center of the paper 3, which is a direction orthogonal to the conveying direction of the paper 3 and orthogonal to the plane of the drawing sheet of FIG. 1. When driven, the sheet feed roller 8 rotates in the counterclockwise direction in FIG. 1. The rotation of the sheet feed roller 8 feeds the paper 3 downstream in the rotational direction, that is, toward the front side of the laser printer 1. The paper 3 is separated and fed one sheet at a time between the sheet feed roller 8 and a separating pad 9 that presses against the sheet feed roller 8. A paper dust roller 14 is disposed downstream of the separating pad 9 in the paper conveying direction for removing paper dust generated by friction between the separating pad 9 and the paper 3. The separating pad 9 and the paper dust roller 14 have approximately the same length as the sheet feed roller 8 in the widthwise direction of the paper 3.

The conveying roller 11 and a paper dust roller 10 form a pair positioned above the sheet feed roller 8. The paper dust roller 10 removes paper dust from the paper 3 that was not removed by the paper dust roller 14. The outer surface of the paper dust roller 10 contacts the conveying roller 11 and follows the rotational movement of the same. Like the paper dust roller 14, the paper dust roller 10 has approximately the same length as the sheet feed roller 8 in the widthwise direction of the paper 3.

The pair of registration rollers 12 is positioned further toward the rear of the laser printer 1 than the conveying roller 11. A U-shaped conveying path 13 is defined inside the casing 2, and the sheet feed roller 8 conveys the paper 3 between the conveying roller 11 and the paper dust roller 10 toward the registration rollers 12 through the conveying path 13. The opposing parts (nip part) of the conveying roller 11 and the paper dust roller 10 are exposed in the conveying path 13 and serve not only to convey the paper 3, but also to remove any remaining paper dust from the surface of the paper 3 to prevent paper dust from being transported to the image-forming unit 5. The top one of the pair of registration rollers 12 is rotatably supported on the bottom of the process cartridge 17 while the bottom one of the registration rollers 12 is rotatably supported in the casing 2.

The laser printer 1 further includes an auger unit 100 and a wiper 103. The paper dust roller 10 is rotatably supported inside the auger unit 100. The wiper 103 has approximately the same width as the paper dust roller 10 in the axial direction of the conveying roller 11. The wiper 103 is formed of a sponge or the like and is disposed so as to slidingly contact the outer surface of the paper dust roller 10 from above. With this construction, dust removed from the paper 3 by the paper dust roller 10 and deposited on the outer surface of the paper dust roller 10 is sheared off by the wiper 103. This operation is described in greater detail later.

The bottom surface of the auger unit 100 forms a portion of a paper guide that confronts the outer surface of the paper 3 and guides the paper 3 when the paper 3 is conveyed through the conveying path 13. An accommodating area 57 for accommodating the process cartridge 17 is provided above the auger unit 100 and below the scanning unit 16, spanning from the front surface of the casing 2 to the center. The accommodating area 57 has an opening for inserting the process cartridge 17. The conveying path near the end of the conveying path 13 is exposed in the accommodating area 57. In other words, the process cartridge 17 is accommodated in the accommodating area 57 along a portion of the conveying path 13. The paper 3 conveyed along the conveying path collides with the bottom surface of the process cartridge 17 accommodated in the accommodating area 57 and is conveyed along this bottom surface to the nip part of the registration rollers 12.

The opening of the accommodating area 57 is exposed to the outside of the casing 2 from the front side of the casing 2. A front cover 55 is provided to cover the opening of the accommodating area 57. A bottom end of the front cover 55 is supported by a support shaft 55*a* located above the sheet feed cassette 6 so that a top free end of the front cover 55 can swing open or closed about the support shaft 55*a*. The accommodating area 57 is exposed when the free end of the front cover 55 is swung downward about the support shaft 55*a*. A paper supply tray (not shown) is provided on the front cover 55 and can swing open or closed about a support shaft provided near the support shaft 55*a*. When open, paper 3 can be loaded on top of the supply tray. A feeding roller 54 protrudes from the wall of the casing 2 near the support shaft 55*a* and feeds the paper 3 loaded on the supply tray into the image-forming unit 5. The auger unit 100 divides, into two sections, the paper guide that confronts the outer surface of the paper 3 being conveyed through the conveying path 13. A slit-shaped opening extending in the axial direction of the conveying roller 11 is formed in the paper guide at this divided position. With this configuration, the paper 3 conveyed into the casing 2 by the feeding roller 54 enters the conveying path 13 through the slit-shaped opening and is conveyed toward the image-forming unit 5.

Next, the scanning unit 16 will be described in more detail. The scanning unit 16 is disposed in the casing 2 directly below a discharge tray 46. The scanning unit 16 includes a laser light-emitting unit (not shown), a polygon mirror 19, an fθ lens 20, three reflecting mirrors 21, and cylinder lens 22. The laser light-emitting unit is for irradiating laser light. The polygon mirror 19 is driven to rotate in order to scan laser light emitted from the laser light-emitting unit in a main scanning direction. The fθ lens 20 is for regulating the laser light scanned by the polygon mirror 19 at a uniform scanning speed. The reflecting mirrors 21 are for modifying the optical path by reflecting the laser light in order to irradiate the scanned laser light outside the scanning unit 16. The cylinder lens 22 is for receiving incident laser light reflected by two of the reflecting mirrors 21 disposed on the upstream end of the optical path and for correcting optical face tangle error in the subscanning direction of the laser light in order to form an image on a photosensitive drum 27 via the remaining reflecting mirror 21 disposed on the downstream end of the optical path. Hence, in the scanning unit 16, laser light emitted from the laser light-emitting unit based on print data follows a path indicated by the broken line L in FIG. 1 and is passed through or reflected off components in the order polygon mirror 19, fθ lens 20, two reflecting mirrors 21, cylinder lens 22, and one remaining reflecting mirror 21 in order to scan laser light over the surface of the photosensitive drum 27 in the process cartridge 17.

Next, the process cartridge 17 will be described. The process cartridge 17 includes a drum cartridge 23 and a developing cartridge 24 that is detachably mounted on the drum cartridge 23. The drum cartridge 23 includes the photosensitive drum 27, a charger 29, and a transfer roller 30. The developing cartridge 24 includes a developing roller 31, a supply roller 33, and a toner hopper 34.

When the process cartridge 17 including the developer cartridge 24 mounted on the drum cartridge 23 is accommodated in the accommodating area 57, the photosensitive drum 27 of the drum cartridge 23 can rotate in the direction indicated by the arrow (clockwise in FIG. 1) while in contact with the developing roller 31.

The charger 29 is disposed above the photosensitive drum 27 at a position separated from the photosensitive drum 27 by a predetermined distance. The charger 29 is a Scorotron charger that generates a corona discharge from a tungsten wire, for example, and is applied with a charging bias to charge the surface of the photosensitive drum 27 to a uniform positive charge.

The photosensitive drum 27 includes positively-charging organic photo conductor coated on a conductive base material. The positively-charging organic photo conductor is made from a charge transfer layer dispersed with a charge generation material on a charge generation layer. When the photosensitive drum 27 is exposed by a laser light, the charge generation material absorbs the light and generates a charge. The charge is transferred onto the surface of the photosensitive drum 27 and the conductive base material through the charge transfer layer and counteracts the surface potential charged by the charger 29. As a result, a potential difference is generated between regions of the photosensitive drum 27 that were exposed and regions that were not exposed by the laser light. By selectively exposing and scanning the surface of the photosensitive drum 27 with a laser beam based on print data, an electrostatic latent image is formed on the photosensitive drum 27.

The developing roller 31 is disposed further downstream than the charger 29 with respect to the rotation direction of the photosensitive drum 27. The developing roller 31 is rotatable counterclockwise as indicated by an arrow in FIG. 1. The developing roller 31 includes a roller shaft made from metal coated with a roller made from a conductive rubber material. A development bias is applied to the developing roller 31.

The supply roller 33 is rotatably disposed beside the developing roller 31 on the opposite side from the photosensitive drum 27 across the developing roller 31. The supply roller 33 is in pressed contact with the developing roller 31. The supply roller 33 is rotatable counterclockwise as indicated by an arrow in FIG. 1, which is the same rotation direction as the developing roller 31. The supply roller 33 includes a roller shaft made of metal coated with a roller made of a conductive foam material and charges toner supplied to the developing roller 31 by friction.

The toner hopper 34 is provided beside the supply roller 33 and filled with developer, which is to be supplied to the developing roller 31 by the supply roller 33. In this embodiment, non-magnetic, positive-charging, single-component toner is used as a developer. The toner is a polymeric toner obtained by copolymerizing polymeric monomers using a well-known polymerization method, such as suspending polymerization. Examples of polymeric monomers include styrene monomers and acrylic monomers. Styrene is an example of a styrene monomer. Examples of acrylic monomers include acrylic acid, alkyl (C1 to C4)acrylate, and alkyl (C1 to C4)methacrylate. A coloring agent such as carbon black, wax, and the like are mixed in the polymeric toner. An externally added agent such as silica is also added in order to improve fluidity. A particle diameter of the polymeric toner is approximately 6 μm to 10 μm.

The transfer roller 30 is disposed below the photosensitive drum 27 and downstream from the developing roller 31 with respect to the rotating direction of the photosensitive drum 27. The transfer roller 30 is rotatable counterclockwise as indicated by an arrow in FIG. 1. The transfer roller 30 includes a metal roller shaft coated with a roller made from an ion-conductive rubber material. During transfer processes, a transfer bias is applied to the transfer roller 30. The transfer bias generates a potential difference, between the surfaces of the photosensitive drum 27 and the transfer roller 30, that electrically attracts toner that electrostatically clings to the surface of the photosensitive drum 27 to the surface of the transfer roller 30.

The fixing unit 18 is disposed to the side and downstream of the process cartridge 17. The fixing unit 18 includes a heating roller 41 and a pressing roller 42 for pressing the heating roller 41. A conveying path 58 is provided between the process cartridge 17 and the fixing unit 18 for guiding the paper 3 that has passed through the nip part of the photosensitive drum 27 and the transfer roller 30 to a nip part of the fixing roller 41 and the heating roller 42 in the fixing unit 18.

The heating roller 41 is formed by coating a hollow aluminum roller with a fluorocarbon resin and sintering the assembly. The heating roller 41 includes a metal tube and a halogen lamp 41a disposed inside a metal tube. The pressing roller 42 includes a base that has a low-hardness silicon rubber formed around a shaft. The base is covered by a tube formed of a fluorocarbon resin. The shaft is urged upward by a spring (not shown), pressing the pressing roller 42 against the heating roller 41. While the sheet 3 from the process cartridge 17 passes between the heating roller 41 and the pressing roller 42, the heating roller 41 pressurizes and heats toner that was transferred onto the sheet 3 in the process cartridge 17, thereby fixing the toner onto the sheet 3. Afterward, the sheet 3 is discharged from the fixing unit 18 by the conveying rollers 43 and transported along a sheet discharge path 44.

The discharge tray 46 is formed as a depression in the top of the casing 2 from the center to the front side of the casing 2, such that the slope of the discharge tray 46 grows smaller toward the front of the casing 2. The discharge tray 46 functions to hold stacked sheets of the paper 3 that have been printed. After an image has been formed on the paper 3 in the image-forming unit 5, the paper 3 is guided along the discharge path 44, which is formed in an arc, and is discharged onto the discharge tray 46 by a pair of discharge rollers 45 disposed at the end of the discharge path 44.

The laser printer 1 further includes a duplex printing unit 26, which is disposed below the image-forming unit 5 and above the paper supply cassette 6. The duplex printing unit 26 includes reverse conveying rollers 51, 52, and 53 arranged in a substantially horizontal orientation. A reverse conveying path 47 is provided on the rear side of the reverse conveying roller 51, while a reverse conveying path 48 is provided on the front side of the reverse conveying roller 53. The reverse conveying path 47 extends from the discharge roller 45 to the reverse conveying rollers 51 and branches off from the discharge path 44 near the end of the discharge path 44 in the conveying direction of the paper 3 such that a paper 3 will be guided to the duplex printing unit 26 when fed in a reverse direction. The reverse conveying path 48, on the other hand, extends from the reverse conveying roller 53 to the register rollers 12 for guiding a paper 3 to the image-forming unit 5.

Next, the construction of the auger unit 100 and peripheral components will be described with reference to FIGS. 2 and 3.

Figure 2:
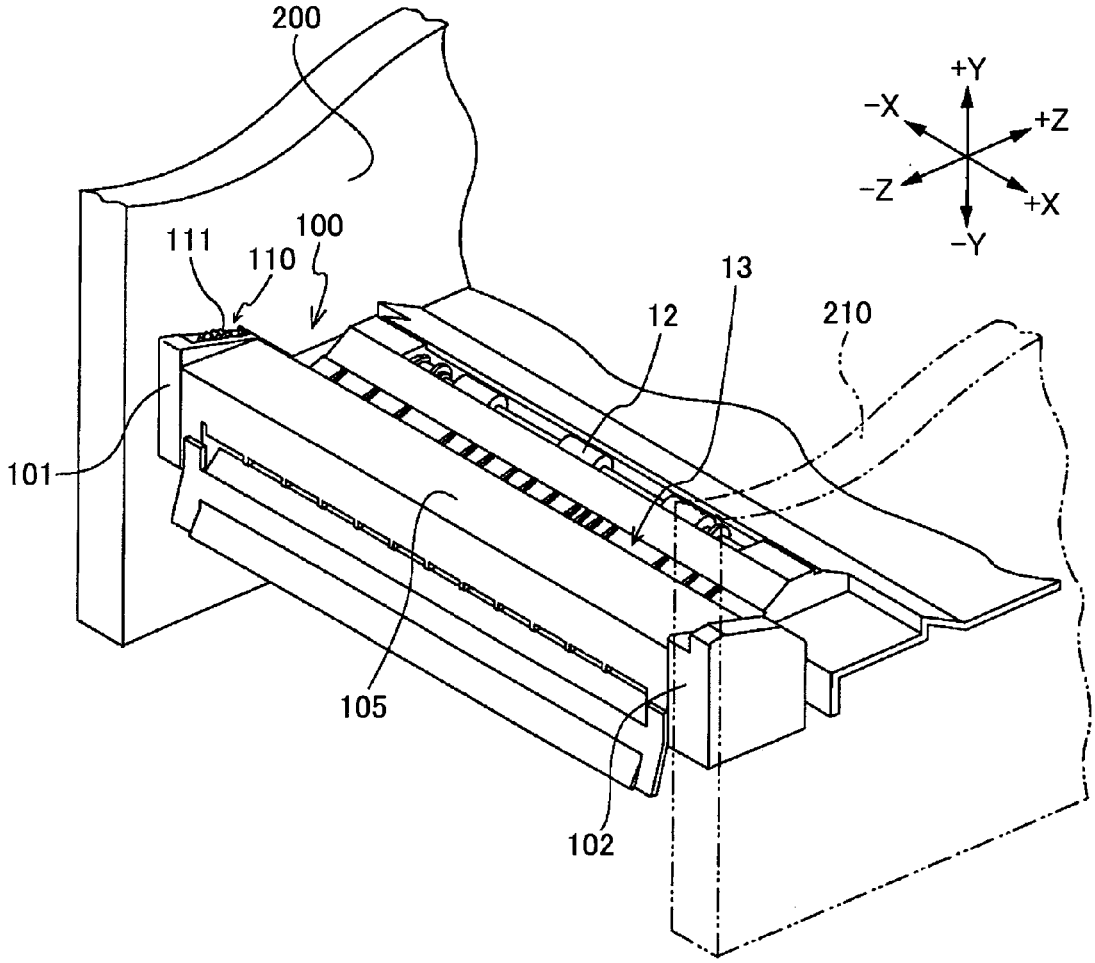
FIG. 2 is a perspective view at an angle from the front showing an auger unit employed in the laser printer of FIG. 1.

As shown in FIG. 2, the auger unit 100 is formed in the shape of a trapezoidal pillar that extends between the left and right frames 200 and 210. Fixing parts 101 and 102 are provided one on either end of the auger unit 100 for fixing the auger unit 100 to the inner surfaces of the frames 200 and 210. As shown in FIG. 3, an auger 104 is rotatably supported inside the auger unit 100. More specifically, as shown in FIG. 1, the auger 104 is positioned downstream of the portion of the paper dust roller 10 contacting the paper 3 and upstream of the wiper 103 with respect to the rotational direction of the paper dust roller 10. The axis of the auger 104 extends in a direction orthogonal to the planes occupied by the frames 200 and 210. The auger 104 is driven to rotate in association with the conveying roller 11.

Figure 3:
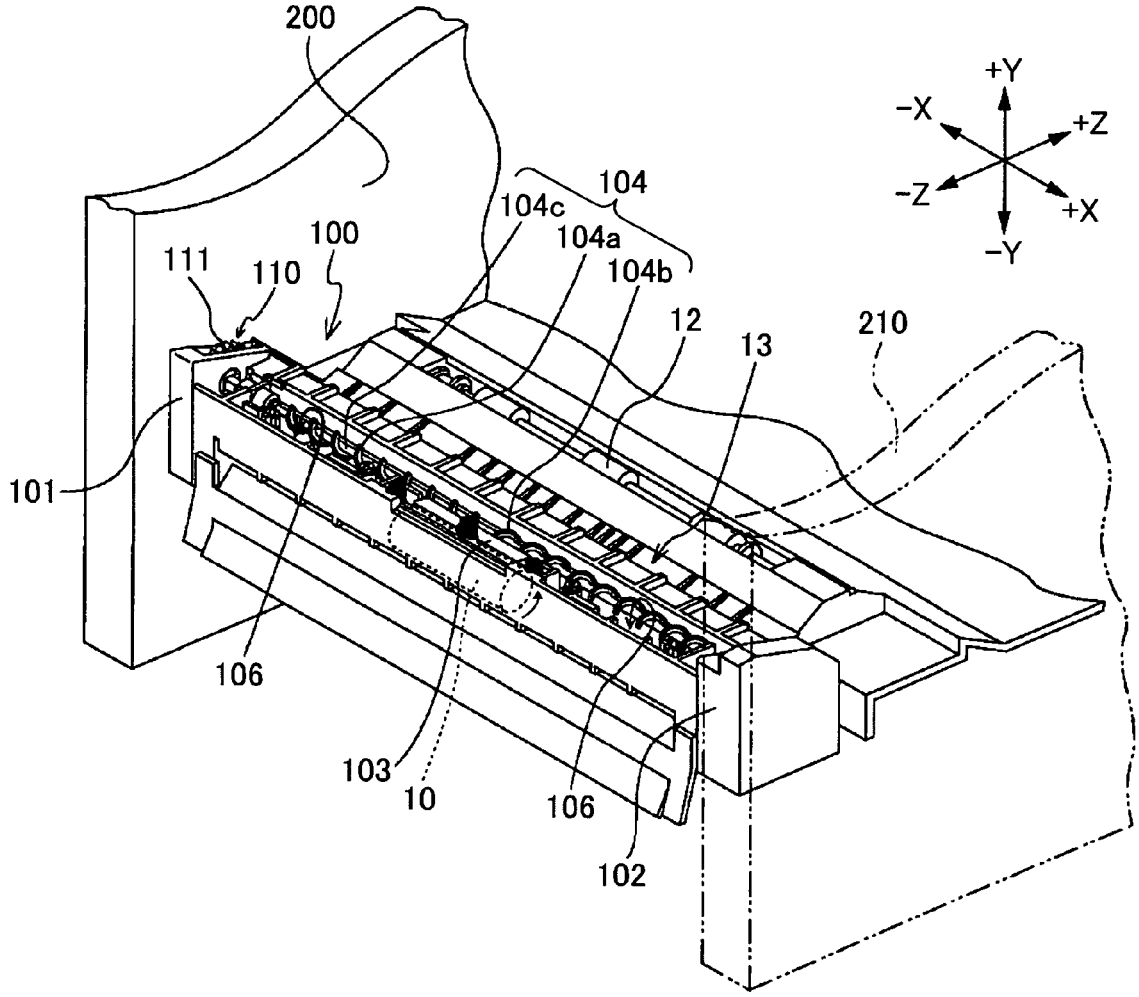
FIG. 3 is a perspective view at an angle from the front showing the auger unit with a cover removed.

As shown in FIG. 3, the auger 104 includes a fin 104*a*, a fin 104*b*, and a rotational shaft 104*c*. The fin 104*a* has a right-handed spiral shape and extends from the axial center toward the left frame 200 side. The fin 104*b* has a left-handed spiral shape and extends from the axial center toward the right frame 210 side. The fin 104*a* forms a mirror image of the fin 104*b* with reference to the axial center. Paper dust storage units 106 for collecting paper dust are provided at both ends of the rotational shaft 104*c*.

As shown in FIG. 2, the auger unit 100 includes a cover 105 providing a top surface of the auger unit 100. The cover 105 serves as a part of the bottom surface of the accommodating area 57. The auger 104 and the wiper 103 are exposed by removing the cover 105 (FIG. 3).

With this construction, when the paper 3 is conveyed through the conveying path 13, the paper dust roller 10 rotates in the clockwise direction in FIG. 1, following the movement of the conveying roller 11 or the paper 3, and scrapes off any remaining paper dust from the surface of the paper 3. Paper dust scraped by the paper dust roller 10 is restricted from rotating around on the surface of the paper dust roller 10 by the wiper 103, which contacts the surface of the paper dust roller 10. Paper dust restricted by the wiper 103 is scraped off by the fins 104*a* and 104*b* of the auger 104, which is driven to rotate near the point at which the wiper 103 contacts the paper dust roller 10, but upstream of the wiper 103 with respect to the rotational direction of the paper dust roller 10. As the auger 104 rotates, the paper dust is moved along the surfaces of the spiral shaped fins 104*a* and 104*b* from the center of the auger 104 toward both ends thereof and is accumulated in the paper dust storage units 106. Hence, paper dust is prevented from falling onto the surface of the paper 3.

As shown in FIG. 3, a dial 110 is provided inside the fixing part 101 on the left side of the auger unit 100. The dial 110 is formed in a disk shape and rotates about the rotational shaft 104*c* of the auger 104. An operating part 111 shaped like gear teeth is formed on the outer periphery of the dial 110. The top of the operating part 111, that is, a portion of the dial 110, is exposed in the accommodating area 57 through the fixing part 101. The remaining part of the dial 110 is accommodated in the fixing part 101. By manipulating the operating part 111 to rotate the dial 110, a user can manually rotate the auger 104. The auger 104 moves in association with the conveying roller 11 through a gear drive mechanism described next. Hence, the conveying roller 11 can be driven to rotate by rotating the auger 104.

Next, the gear drive mechanism will be described with reference to FIG. 4. A depiction of the radius of each gear based on the depth of the gear teeth has been omitted from the drawing.

The gear drive mechanism transmits a driving force from a drive motor 205 to various components of the laser printer 1, including the auger 104 and the conveying roller 11. The gear drive mechanism includes a plurality of gears mounted on the outer surface of the left frame 200, which has a substantially rectangular shape. The shaft 104*c* of the auger 104 and a shaft 11*a* of the conveying roller 11 (FIG. 1) penetrate the frame 200.

Gear teeth are directly formed on a drive shaft 206 of the drive motor 205. An idle gear 208 engages with the drive shaft 206 from the above. The idle gear 208 is a two-stage gear having a small-diameter gear 209 that engages with an idle gear 211 and a drum gear 250. The idle gear 211 is for transmitting a driving force to the feeder unit 4, and the drum gear 250 is for driving the photosensitive drum 27 to rotate. The idle gear 211 is positioned on the front side of the idle gear 208, while the drum gear 250 is positioned diagonally upward and behind the idle gear 208.

An idle gear 260 engages with the drum gear 250 from the above. An idle gear 263, which is a two-stage gear, engages with the idle gear 260 from the front side thereof. The idle gear 263 has a small-diameter gear 264. A developing gear 266 is engaged with the small-diameter gear 264 from the front side thereof. A driving force is transmitted to the developing roller 31 and the like in the developer cartridge 24 via the developing gear 266. The idle gear 260 is also a two-stage gear having a small-diameter gear 261 engaged with an idle gear 271, which in turn is sequentially engaged with idle gears 273, 275, 277, and 279 arranged diagonally upward and rearward. A paper discharge gear 281 engaged with the final idle gear 279 transmits a driving force to the discharge rollers 45.

An idle gear 253, which is also a two-stage gear, is engaged with the drum gear 250 at a position behind the drum gear 250. The idle gear 253 has a small-diameter gear 254 that engages with a fixing gear 256 positioned diagonally below and behind the small-diameter gear 254. By transferring a driving force to the fixing gear 256, the fixing roller 41 and the heating roller 42 in the fixing unit 18 are driven to rotate.

An option gear 213 engages with the idle gear 211 on the bottom side thereof. The option gear 213 is for transmitting a driving force required to convey paper accommodated in a second paper supply unit (not shown) when the second paper supply unit is mounted on the casing 2. The idle gear 211 is a two-stage gear for transmitting a driving force to the feeder unit 4 and has a small-diameter gear 212. A sun gear 218, which is a two-stage gear, has a small-diameter gear 217 that engages with the small-diameter gear 212 at a position diagonally upward and in front of the small-diameter gear 212.

A registration gear 222 for driving the bottom registration roller 12 is engaged with the sun gear 218 from the top thereof. A paper supply gear 220 for transmitting a driving force to the sheet feed roller 8 is engaged with the small-diameter gear 217 at a position diagonally downward and in front of the same.

A planetary gear 224 engages with the small-diameter gear 217 at a position between the registration gear 222 and the paper supply gear 220. An idle gear 227 is engaged with the planetary gear 224. A conveying gear 229, which is a two-stage gear, has a small-diameter gear 230 that is engaged with the idle gear 227. The conveying gear 229 is positioned farther forward than the registration gear 222 and transfers a driving force for driving the conveying roller 11. An auger gear 232 is engaged with the conveying gear 229 for driving the auger 104 to rotate in association with the conveying roller 11. The rotational center of the conveying gear 229 and the rotational center of the auger gear 232 are fixed to the shaft 11*a* of the conveying roller 11 and the rotational shaft 104*c* of the auger 104, respectively. Further, the dial 110 described above is mounted on the rotational shaft 104*c*. Hence, when the conveying roller 11 is driven to rotate, the same driving force also drives the auger 104 and the dial 110 to rotate.

The shafts of most gears described above are supported between the surface of the frame 200 and a gear shaft supporting plate 290 mounted on the frame 200. While engaged with the sun gear 218, the planetary gear 224 can move within a short arc around the axis of the sun gear 218 while maintaining the same distance between the axis 224*a* of the planetary gear 224 and the axis 218*a* of the sun gear 218. The range of movement of the planetary gear 224 is regulated by slide bearings 226 formed as grooves in the frame 200 and the gear shaft supporting plate 290. When the planetary gear 224 is moved to the right around the sun gear 218 (clockwise in FIG. 4) to the right edge of the movement range regulated by the slide bearings 226 (edge toward the front surface of the casing 2) as shown in FIG. 4, the planetary gear 224 engages with the idle gear 227, enabling a driving force to be transmitted between the sun gear 218 and the idle gear 227 via the planetary gear 224.

Next, the operations of the laser printer 1 during a printing process will be described with reference to FIGS. 1 and 4. When the laser printer 1 receives print data from a host computer (not shown), the drive motor 205 is driven. A charging bias is applied to the Scorotron-type charger 29, and a developing bias is applied to the developing roller 31. At this time, a transfer reverse bias is applied to the transfer roller 30 for cleaning the transfer roller 30 by transferring residual toner from the transfer roller 30 to the photosensitive drum 27. The charger 29 charges toner accumulated on the photosensitive drum 27, and the developing roller 31 recovers the toner. Subsequently, a transfer bias is applied to the transfer roller 30, after which the printing process begins. In the printing process, the rotating sheet feed roller 8 picks up the topmost sheet of paper 3 by a frictional force generated between the paper 3 and the sheet feed roller 8 and conveys the paper 3 to the registration rollers 12 via the conveying roller 11.

When printing on the paper 3 loaded on a paper supply tray (not shown) equipped with an automated feeding mechanism, operations on a host computer (not shown) are performed to indicate that this supply tray is to be used. In this case, the paper 3 is picked up by the rotation of the feeding roller 54 and conveyed via the conveying roller 11 to the registration rollers 12. The registration rollers 12 register the paper 3 and convey the paper 3 at a timing designed to match the leading edge of the paper 3 with the leading edge of a visible image formed on the surface of the photosensitive drum 27.

Figure 4:
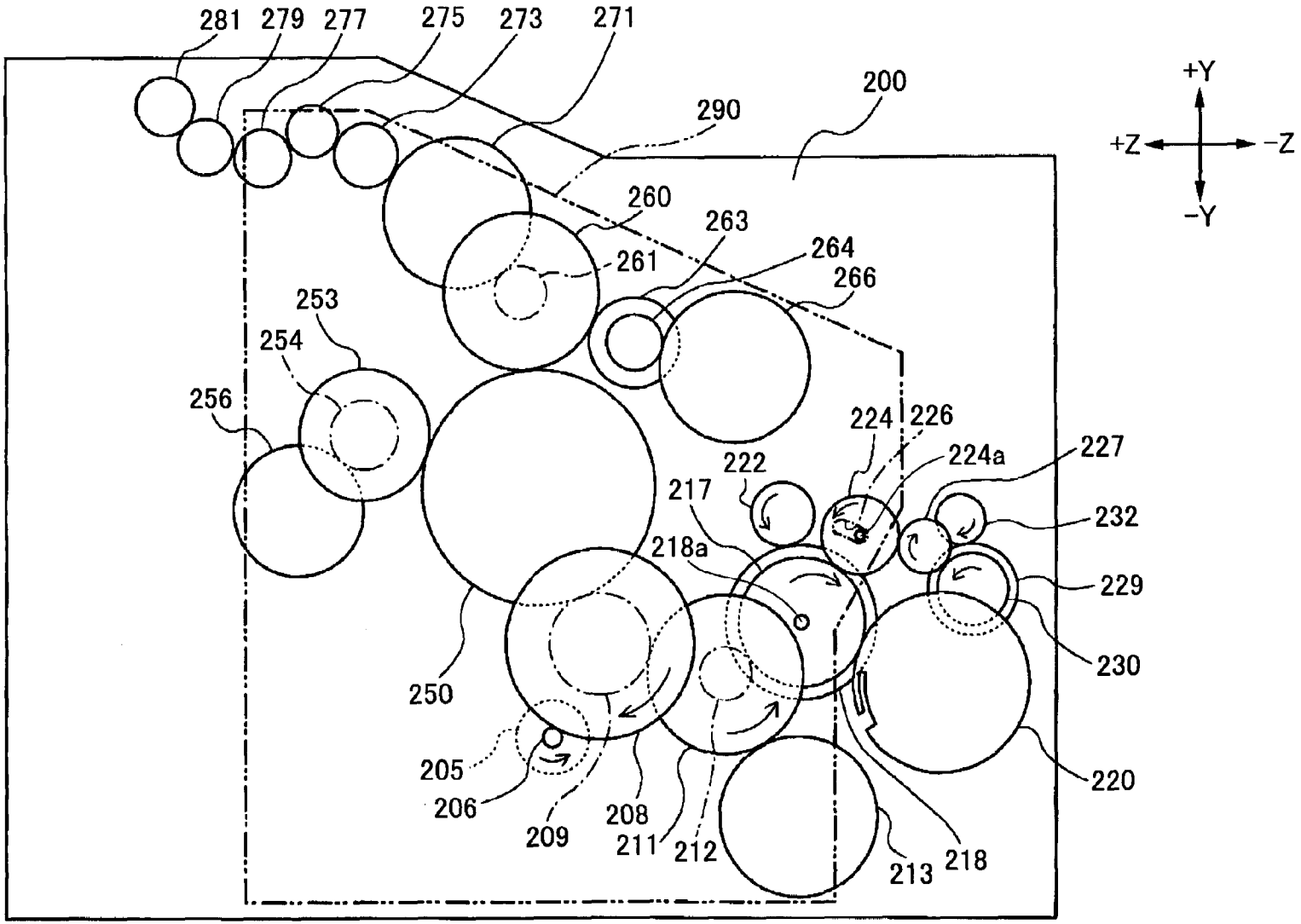
FIG. 4 is an explanatory diagram showing a gear drive mechanism provided on the left frame of the casing when viewed from the left side.

The drive shaft 206 of the drive motor 205 shown in FIG. 4 is driven to rotate counterclockwise in FIG. 4 when forming an image. The sun gear 218 is driven to rotate in the clockwise direction in FIG. 4 by the idle gears 208 and 211 rotating in association with the drive shaft 206. As a result, the shaft 224*a* of the planetary gear 224 moves along the slide bearings 226, following the rotation of the sun gear 218, until the shaft 224*a* reaches the right edge of the slide bearings 226 and the planetary gear 224 engages with the idle gear 227.

The registration gear 222 and the planetary gear 224 both rotate counterclockwise in FIG. 4 along with the clockwise rotation of the sun gear 218. This driving force is transferred to the conveying gear 229 via the idle gear 227, causing the conveying gear 229 to rotate in the counterclockwise direction. The conveying gear 229 in turn drives the auger gear 232 to rotate clockwise in FIG. 4. The conveying roller 11, the auger 104, and the bottom registration roller 12 disposed coaxially with the conveying gear 229, the auger gear 232, and the registration gear 222 are driven to rotate counterclockwise, clockwise, and counterclockwise, respectively. As a result, the paper 3 is conveyed to the image-forming unit 5, and paper dust removed from the paper 3 by the paper dust roller 10 opposing the conveying roller 11 is transported to the paper dust storage units 106 by the auger 104.

In the scanning unit 16, laser driving signals are generated based on bitmap data created from the print data, and laser light is generated by the laser light-emitting unit and irradiated on the polygon mirror 19 based on the laser driving signals. The polygon mirror 19 moves the irradiated laser light in a main scanning direction (orthogonal to the direction for conveying the paper 3), irradiating the light on the fθ lens 20. The fθ lens 20 converts the laser light scanned by the polygon mirror 19 at a constant angular rate to a constant scanning speed. The direction of the laser light is changed by two of the reflecting mirrors 21 and directed onto the cylinder lens 22 for focusing the light beam. Subsequently, the remaining reflecting mirror 21 reflects the laser light onto the surface of the photosensitive drum 27 to form an image thereon.

The charger 29 applied with a charging bias charges the surface of the photosensitive drum 27 to a surface potential of approximately 1000V. Then, the laser beam from the scanning unit 16 scans across the surface of the photosensitive drum 27 in the main scan direction while the photosensitive drum 27 rotates in the clockwise direction. The laser beam selectively exposes and does not expose the surface of the photosensitive drum 27. That is, portions of the surface of the photosensitive drum 27 that are to be developed are exposed by the laser light and portions that are not to be developed are not exposed. The surface potential of the photosensitive drum 27 decreases to approximately 200V at exposed portions (bright parts). Because the photosensitive drum 27 rotates clockwise as indicated by an arrow in FIG. 1 at this time, the laser beam also exposes the photosensitive drum 27 in an auxiliary scanning direction, which is also the conveying direction of the sheet 3. As a result of the two scanning actions, an electrical invisible image, that is, an electrostatic latent image is formed on the surface of the photosensitive drum 27 from exposed areas and unexposed areas (dark parts).

At this time, toner supplied from the toner hopper 34 is positively tribocharged between the supply roller 33 and the developing roller 31. The toner is carried in a thin layer on the developing roller 31 after being regulated at a uniform thickness. A positive bias of approximately 400V is applied to the developing roller 31. The toner, which is borne on the developing roller 31 and charged positively, is transferred to the electrostatic latent image formed on the surface of the photosensitive drum 27 when the toner comes into contact with the photosensitive drum 27. That is, because the potential of the developing roller 31 is lower than the potential of the dark parts (+1000V) and higher than the potential of the bright parts (+200V), the positively-charged toner selectively moves to the bright parts where the potential is lower. In this way, a visible image of toner is formed on the surface of the photosensitive drum 27.

When the paper 3 passes between the photosensitive drum 27 and the transfer roller 30, a transfer forward bias is applied to the transfer roller 30. The transfer forward bias is a negative constant current at about −1000V, much lower than the potential in bright parts of the photosensitive drum 27 (+200V), causing the visible image formed on the surface of the photosensitive drum 27 to transfer onto the paper 3.

Then, the sheet 3 having the toner transferred thereon is conveyed to the fixing unit 18. The heating roller 41 of the fixing unit 18 applies heat of approximately 200 degrees, and the pressing roller 42 applies a pressure, to the sheet 3 with the toner image formed thereon so as to fix the toner image permanently on the sheet 3. Note that the heating roller 41 and the pressing roller 42 are each grounded through diodes so that the surface potential of the pressing roller 42 is lower than the surface potential of the heating roller 41. Accordingly, the positively charged toner that clings to the heating roller 41 side of the sheet 3 is electrically attracted to the lower surface potential of the pressing roller 42. Therefore, the potential problem of the toner image being distorted because the toner is attracted to the heating roller 41 at the time of fixing is prevented.

The sheet delivery roller 43 conveys the sheet 3 with the fixed toner image on the sheet delivery path 44 and delivers the sheet 3 to the sheet discharge tray 46 with a toner image side facing downward. Similarly, the sheet 3 to be printed next is stacked over the earlier delivered sheet 3 with a printed surface facing downward in the discharge tray 46. In this way, a user can obtain the sheets 3 stacked in the order of printing.

If a paper jam occurs along the conveying path 13, a driving of the drive motor 205 is halted when the paper jam is detected by a paper jam detecting mechanism well known in the art. When notified of the paper jam, a user opens the front cover 55 to remove the jammed paper from the conveying path 13. By removing the process cartridge 17 from the accommodating area 57, the user can see the end of the conveying path 13 exposed in the accommodating area 57. If the jammed paper is exposed in this end portion, the user can pull out the jammed paper. Additionally, the user can inspect the beginning area of the conveying path 13 by removing the paper cassette 6. If the jammed paper is exposed at this beginning area, the user can similarly pull the jammed paper out from this area.

In some cases, paper jamming in the conveying path 13 may fold up like an accordion, making it impossible to resolve the paper jam by the methods described above. In such cases, the user can remove the jammed paper by operating the dial 110 to rotate the conveying roller 11.

More specifically, by opening the front cover 55 and removing the process cartridge 17 from the accommodating area 57, the user can place a finger on the operating part 111 to rotate the dial 110. When the user rotates the dial 110 clockwise in FIG. 1, the auger gear 232 shown in FIG. 4 also rotates clockwise in FIG. 4. Further, the idle gear 227, which moves in association with the auger gear 232 via the conveying gear 229, is driven to rotate clockwise in FIG. 4.

Since the operating part 111 is formed on the top portion of the dial 110 that is exposed in the accommodating area 57, the user can pull the operating part 111 toward the front surface of the casing 2 to rotate the dial 110 in a clockwise direction in FIG. 1.

When the idle gear 227 is driven to rotate in this manner, the planetary gear 224 engaged with the idle gear 227 also attempts to rotate counterclockwise in FIG. 4. However, since the drive motor 205 is halted, the small-diameter gear 209, the idle gear 211, and the sun gear 218 engaged in series with the drive shaft 206 of the drive motor 205 are also stopped. Hence, the driving force transferred to the planetary gear 224 causes the shaft of the planetary gear 224 to move along the slide bearings 226. In other words, the planetary gear 224 separates from the idle gear 227. Accordingly, the gears that are driven to rotate by the rotation of the dial 110 include only the auger gear 232, the conveying gear 229, and the idle gear 227. By disengaging these three gears from the drive motor 205, the load is removed from the three gears since the driving force of the drive motor 205 is no longer communicated thereto, enabling the dial 110 to be rotated with ease.

As the user continues to rotate the dial 110 clockwise in FIG. 1, the conveying roller 11 is driven to rotate counterclockwise in FIG. 1, applying an external force to the jammed paper in the conveying path 13 for moving the paper in the conveying direction. The user can continue applying a conveying force to the jammed paper until the trailing edge of the paper passes the nip point between the conveying roller 11 and the paper dust roller 10, at which point the jammed paper is exposed in the accommodating area 57. The user can now grip the jammed paper and pull the paper out of the casing 2 without resistance.

With this construction, operating the dial 110 to rotate the conveying roller 11 switches the drive motor 205 and the conveying roller 11 to a non-communicating state, eliminating the torque applied by the drive motor 205 and enabling the dial 110 to be rotated easily.

Alternatively, if the user rotates the dial 110 counterclockwise in FIG. 1, the planetary gear 224 moves in the opposite direction to engage with the idle gear 227. Since the planetary gear 224 is not separated from the idle gear 227, the three gears 232, 229, 227 are linked to the drive motor 205 and the driving force of the drive motor 205 is communicated to the gears 232, 229, 227. Hence, a load is applied to the gears 232, 229, 227, preventing the dial 110 from being easily rotated. Accordingly, in the initial stage of the process to resolve a paper jam, the user can tell that it is easy to pull the operating part 111 of the dial 110 toward the front of the casing 2 and difficult to push the operating part 111 toward the back of the casing 2. Accordingly, the user can tell that the dial 110 should be pulled toward the front of the casing 2 in order to resolve the paper jam. Moreover, although the auger 104 rotates in the reverse direction when the dial 110 is pushed toward the back of the casing 2, paper dust can be prevented from flowing back toward the axial center of the auger 104 by the above configuration in which the dial 110 is prevented from rotating counterclockwise in FIG. 1.

As described above, a portion of the dial 110, that is, the top area of the operating part 111 is exposed in the accommodating area 57 from the fixing part 101, while the remaining portion of the dial 110 is accommodated in the fixing part 101. With this construction, the dial 110 can be operated without exposing the entire dial 110 in the accommodating area 57, and interference between the dial 110 and the process cartridge 17 can be prevented when mounting or removing the process cartridge 17. Moreover, interference between the dial 110 and a paper 3 being conveyed through the transport path 13 can be prevented.

Specifically, disposing the dial 110 near the front cover 55 in the accommodating area 57 (near the opening in the accommodating area 57) facilitates operations and improves convenience. However, if the entire dial 110 is exposed in the accommodating area 57, the dial 110 and the portion of the process cartridge 17 interface with one another when mounting or removing the process cartridge 17. In such a case, it is necessary to provide a mechanism for moving the dial 110 when mounting or removing the process cartridge 17, or to provide a recessed groove along the entire length of the process cartridge 17 in the mounting direction in the area that interferes with the dial 110, or to expand the accommodating area 57 to include a section for accommodating the dial 110. Further, if there is a possibility that the process cartridge 17 contacts the dial 110 when mounting or removing the process cartridge 17, even if the dial 110 does not interfere with the process cartridge 17, it is necessary to prevent this contact from rotating the dial 110 by placing a heavy load on the dial 110 to make rotation difficult or by restricting rotation of the dial 110 in one direction in order to avoid worsening the condition of the paper jam.

However, in the present embodiment, only a portion of the dial 110 is exposed in the accommodating area 57, while the remainder is accommodated in the fixing part 101. Accordingly, it is possible to prevent interference between the process cartridge 17 and the dial 110, and the laser printer 1 can be kept small since it is not necessary to expand the accommodating area 57 in order to accommodate the entire dial 110.

If the dial 110 is operated while the developer cartridge 24 is still mounted in the casing 2, that is, while the downstream end of the conveying path 13 is not exposed, jammed paper conveyed by the conveying roller 11 may collide with the nip part of the registration rollers 12, rippling and becoming densely packed, thereby worsening the state of the paper jam. However, in the present embodiment the dial 110 is provided coaxially with the rotational shaft 104*c* of the auger 104, and the developer cartridge 24 is positioned above the dial 110 when the process cartridge 17 is mounted in the accommodating area 57, as shown in FIG. 1. Accordingly, due to interference from the developer cartridge 24, the user will have difficulty operating the dial 110, even if the user opens the front cover 55 on the laser printer 1 and touches the operating part 111 on the dial 110. Hence, the user must first remove the developer cartridge 24 (process cartridge 17) before manipulating the dial 110. In other words, the user can be compelled to operate the dial 110 while the end area of the conveying path 13 is exposed, thereby preventing a worsening in the state of the jammed paper. By using the process cartridge 17 to restrict operation of the dial 110 in this way, the user can be prevented from incorrectly operating the dial 110, without the need for providing a shutter or the like to cover the operating part 111.

Further, by providing the dial 110 in the fixing part 101, it is possible to increase the diameter of the dial 110. As a result, the dial 110 is easy to operate even when only a portion of the operating part 111 is exposed from the fixing part 101.

Further, by providing the dial 110 in the fixing part 101, the dial 110 can be disposed near the end of the conveying path 13, allowing the user to operate the dial 110 while monitoring the jammed paper.

By removing the process cartridge 17 from the accommodating area 57, a large space in the casing 2 is vacated, and the end area of the conveying path 13 and the operating part 111 are exposed in this large space, which is accessible from outside the casing 2. Accordingly, the user can easily rotate the dial 110 and remove the jammed paper, thereby facilitating the process for resolving a paper jam.

Because the dial 110 is disposed coaxially with the auger 104, it is possible to conserve more space by not requiring a separate bearing for rotatably supporting the dial 110.

When jammed paper is exposed in the accommodating area 57, the user can pull out the paper by hand. Alternatively, the user may rotate the dial 110 until the trailing edge of the jammed paper is conveyed downstream of the conveying roller 11 in the conveying path 13 before pulling out the jammed paper. That is, the direction in which the paper 3 is conveyed from the conveying path 13 toward the image-forming unit 5 (toward the rear of the casing 2) is opposite the direction in which the jammed paper exposed in the accommodating area 57 at the end of the conveying path 13 is pulled out from the casing 2 (toward the front of the casing 2). Accordingly, if the jammed paper is pulled when a portion of the paper is positioned at the nip part between the conveying roller 11 and the paper dust roller 10, the load applied to the jammed paper may cause the paper to tear. Therefore, the jammed paper is preferably pulled after operating the dial 110 to discharge the jammed paper from the nip part between the conveying roller 11 and the paper dust roller 10.

Because the rotational axis of the disk-shaped dial 110 is disposed parallel to the shaft 11*a* of the conveying roller 11, a more simplified construction can be achieved for manually rotating the conveying roller 11.

A user can switch from a communicating state for communicating a driving force to a non-communicating state and also rotate the conveying roller 11 only by operating the dial 110. Therefore, the user can resolve a paper jam easily.

Since an inexpensive part, such as the planetary gear 224 can be employed to switch between the communicating state and the non-communicating state, production costs can be reduced.

Because the gear drive mechanism is disposed on one side of the casing 2, the laser printer 1 can be manufactured compact.

While the invention has been described in detail with reference to specific embodiment thereof, it would be apparent to those skilled in the art that many modifications and variations may be made therein without departing from the spirit of the invention, the scope of which is defined by the attached claims.

For example, in the above-described embodiment, the dial 110 is disposed coaxially with the auger 104. However, the dial 110 and the auger 104 need not be disposed coaxially. Instead, the dial 110 may be disposed coaxially with other rollers in the laser printer, such as the conveying roller 11 or the paper dust roller 10. By providing the rotational axis of the dial 110 parallel to the shaft 11*a* of the conveying roller 11, the direction for operating the exposed portion of the operating part 111 (the Z axis in FIG. 1) will be substantially identical to the direction in which the jammed paper is conveyed. If the operational direction of the dial 110 is substantially identical to the conveying direction of the jammed paper, the user can easily imagine the direction to rotate the conveying roller 11 when resolving the paper jam.

When a paper jam is detected by a paper jam detecting means well known in the art, the drive shaft 206 of the drive motor 205 may be driven to rotate in a direction opposite the rotational direction used when conveying the paper 3. For example, by applying a reverse bias to the drive motor 205 for approximately five seconds when a paper jam is detected, the gears in the gear drive mechanism will be temporarily rotated in reverse. Hence, by driving the sun gear 218 to rotate counterclockwise in FIG. 4 with the planetary gear 224 engaged with the small-diameter gear 217 following the rotation of the sun gear 218, the shaft 224*a* of the planetary gear 224 will move in the slide bearings 226 toward the left end thereof. In other words, the planetary gear 224 can be separated from the idle gear 227. When the drive motor 205 is halted after performing this operation, the conveying roller 11 is already capable of rotating freely when the user performs the process to resolve the paper jam, thereby facilitating the user in this process.

The paper dust roller 10 can be completely covered by the process cartridge 17 to prevent the conveying roller 11 from being manually rotated unless the process cartridge 17 is removed.

While a laser printer was given as an example of the image-forming device in the preferred embodiment, the present invention may be applied to another type of image-forming device, such as an inkjet printer, a photocopier, or the like, provided that the image-forming device includes a conveying path for conveying a recording medium to the image-forming means and conveying rollers that are exposed in the conveying path.

What is claimed is:

1. An image-forming device comprising:

a casing within which an accommodating area is formed;

a process cartridge that is detachably accommodated in the accommodating area;

a conveying roller that conveys a recording medium along a conveying path, wherein the process cartridge is accommodated along a section of the conveying path; and a driving member enabling manual driving of the conveying roller, wherein the process cartridge mounted in the accommodating area covers the driving member, thereby preventing operation on the driving member.

2. The image-forming device according to claim 1, wherein the driving member includes an operating part exposed in the accommodating area, the operating part being operated to manually drive the conveying roller.

3. The image-forming device according to claim 2, wherein the operating part of the driving member is partially exposed in the accommodating area.

4. The image-forming device according to claim 2, wherein the operating part is a disk-shaped dial having a rotational axis extending parallel to a rotational axis of the conveying roller.

5. The image-forming device according to claim 1, wherein a portion of the conveying path is revealed when the process cartridge is removed from the accommodating area.

6. The image-forming device according to claim 1, further comprising a drive motor that generates a driving force for driving the conveying roller, a driving force communicating mechanism that switches between a communicating state in which the driving force is transmitted from the drive motor to the conveying roller and a non-communicating state in which the driving force is not transmitted from the drive motor to the conveying roller.

7. The image-forming device according to claim 6, wherein the driving force communicating mechanism is switched from the communicating state to the non-communicating state when the driving member is operated.

8. The image-forming device according to claim 6, wherein the drive motor is driven to rotate in a first direction for conveying the recording medium, and the driving force communicating mechanism is switched from the communicating state to the non-communicating state when the drive motor is driven in a second direction opposite the first direction.

9. The image-forming device according to claim 6, wherein the driving force communicating mechanism includes a planetary gear.

10. The image-forming device according to claim 6, further comprising a first gear provided on a rotational shaft of the drive motor, and a second gear provided on a rotational shaft of the conveying roller, wherein the first gear and the second gear are engaged with each other at one side surface of the casing, and the driving member is disposed on the one side surface of the casing.

11. The image-forming device according to claim 1, further comprising:

a recording-medium supply cassette that is detachably mounted in a bottom section of the casing;

a feeding roller that feeds a recording medium from the recording-medium supply cassette in a back-to-front direction in the casing;

a guide that defines the conveying path in a U-shape through which the recording medium is conveyed and that guides the recording medium supplied by the feeding roller in a front-to-back direction in the casing; and a cover that is disposed on a front surface of the casing and swung open in a direction toward the front of the casing, wherein the accommodating area is disposed above the conveying path; and the driving member is disposed near a downstream end of the guide with respect to a direction in which the recording medium is conveyed.

12. The image-forming device according to claim 1, wherein the casing has a front side and a rear side opposite to the front side, wherein the conveying roller rotates in a direction for conveying the recording medium through the conveying path when the driving member is operated in a back-to-front direction with respect to the casing.

13. The image-forming device according to claim 1, further comprising:

a paper dust removing member that removes paper dust adhering to the recording medium;

an auger that has a shaft and a fin spiral about the shaft, the auger being driven to rotate in cooperation with the driving member, whereby paper dust removed by the paper dust removing member is transported along the shaft of the auger; and a storage unit that stores the paper dust transported by the auger, wherein the conveying roller rotates in a predetermined direction for conveying the recording medium; and the auger is driven to rotate in a direction for transporting the paper dust to the storage unit when the driving member is operated to rotate the conveying roller in the predetermined direction.

14. The image-forming device according to claim 1, further comprising an image-carrying member onto which an electrostatic latent image is formed, wherein the process cartridge includes a developing member that develops a visible image by selectively supplying a developer onto the image carrying member.

15. The image-forming device according to claim 14, further comprising a transfer member that transfers the visible image developed on the image carrying member from the image carrying member to the recording medium.

16. The image-forming device according to claim 1, wherein the driving member is positioned below the process cartridge in a vertical direction and overlaps with the process cartridge in the vertical direction when the process cartridge is mounted in the accommodating area.

17. An image-forming device comprising:

a casing within which an accommodating area is formed;

a process cartridge that is detachably accommodated in the accommodating area;

a conveying roller that is rotatable about a shaft and conveys a recording medium along a conveying path, wherein the process cartridge is accommodated along a section of the conveying path, and the process cartridge is mounted on or removed from the accommodating area in a direction orthogonal to the shaft of the conveying roller; and a driving member enabling manual driving of the conveying roller, wherein the process cartridge mounted in the accommodating area covers the driving member, thereby preventing operation on the driving member.

* * * * *